United States Patent [19]

Hirata et al.

[11] 4,311,928

[45] Jan. 19, 1982

[54] CURRENT-CONTROLLED TYPE DIVISION CIRCUIT

[75] Inventors: Hitoshi Hirata; Akira Nishioka, both of Tokyo, Japan

[73] Assignee: Pioneer Electronic Corporation, Tokyo, Japan

[21] Appl. No.: 102,812

[22] Filed: Dec. 12, 1979

[30] Foreign Application Priority Data

Dec. 14, 1978 [JP] Japan ..... 53-174466

[51] Int. Cl.[3] ..... G06G 7/16; G06G 7/163

[52] U.S. Cl. ..... 307/498; 328/161

[58] Field of Search ..... 328/161; 307/229, 237, 307/355, 362, 490, 493, 498, 499; 330/254

[56] References Cited

U.S. PATENT DOCUMENTS 3,962,650 6/1976 Gay ..... 330/254

3,968,453 7/1976 Hongu et al. ..... 330/254

*Primary Examiner*—John Zazworsky

*Attorney, Agent, or Firm*—Sughrue, Mion, Zinn, Macpeak and Seas

[57] ABSTRACT

In a current-controlled type division circuit, an auxiliary transistor is employed in conjunction with a division control transistor to allow a divisor signal, which normally flows through the division control circuit, to flow through the auxiliary transistor in the case when a division controlling signal applied to the base of the division control transistor falls below a predetermined level. By the provision of the auxiliary transistor, the divisor signal of a predetermined minimum is adapted to be flown therethrough to prevent the gain of the division circuit from exceeding a predetermined maximum.

3 Claims, 3 Drawing Figures

CURRENT-CONTROLLED TYPE DIVISION CIRCUIT

BACKGROUND OF THE INVENTION

The invention relates generally to a current-controlled type division circuit.

In FIG. 1, shown is a circuit diagram of a prior art current-controlled type division circuit. In this figure, a pair of transistors Q1 and Q2 constitute a difference circuit in which the emitters of the respective transistors are commonly connected and the commonly connected emitters thereof are connected to a constant source $I_E$. A dividend signal $e_s$ is applied through a resistor R1 to the base of the transistor Q1. The base of the transistor Q2 is grounded through a resistor R2. The anodes of diodes D1 and D2 are connected to the bases of the transistors Q1 and Q2, respectively, and the cathodes of the diodes D1 and D2 are commonly connected to each other. The collector of a transistor Q3 is connected to the commonly connected cathodes of the diodes D1 and D2. The transistor Q3 has an emitter connected through a resistor R3 to ground and a base to which a division voltage $E_B$ is applied.

In the division circuit thus arranged, the following equation will be established.

$$V_{be1}+V_{d2}=V_{be2}+V_{dl} \tag{1}$$

where $V_{be1}$ and $V_{be2}$represent base-emitter voltages of the transistors Q1 and Q2, respectively, and $V_{d1}$ and $V_{d2}$ represent anode-cathode voltages of the diodes D1 and D2, respectively.

For each of the transistors and also for each of the diodes, the following equation will be introduced.

$$V_{be}(\approx V_d) = \frac{KT}{q}\cdot \ln\frac{I_e}{I_s} \tag{2}$$

where K represents Boltzmann's constant, q an electron density, T an absolute temperature, $I_s$ a backward saturation current and $I_e$ represents an emitter current of the transistor or a forward current of the diode.

Equation (1) can be rewritten as follows.

$$V_{be1}+V_{d2}-V_{be2}-V_{d1}=0 \tag{3}$$

By substituting equation (2) into equation (3), the following will be obtained.

$$\frac{KT}{q}\left(\ln\frac{I_{eQ1}}{I_{sQ1}}+\ln\frac{I_{eD2}}{I_{sD2}}+\ln\frac{I_{sQ2}}{I_{eQ2}}+\ln\frac{I_{sD1}}{I_{eD1}}\right)=0 \tag{4}$$

The following will be obtained by arranging equation (4).

$$\frac{KT}{q}\cdot\ln\frac{I_{eQ1}}{I_{sQ1}}\cdot\frac{I_{eD2}}{I_{sD2}}\cdot\frac{I_{sQ2}}{I_{eQ2}}\cdot\frac{I_{sD1}}{I_{eD1}}=0 \tag{5}$$

In equation (5), since the backward saturation currents $I_s$ of the transistors and those of the diodes can be considered to be approximately equal to one another, the following relationship will be established.

$$\frac{KT}{q}\cdot\ln\frac{I_{eQ1}}{I_{eQ2}}\cdot\frac{I_{eD2}}{I_{eD1}}=0 \tag{6}$$

Therefore, $$\frac{I_{eQ1}}{I_{eQ2}}\cdot\frac{I_{eD2}}{I_{eD1}}=1 \tag{7}$$

Equation (7) can further be rewritten as follows.

$$I_{eQ2}=\frac{I_{eD2}}{I_{eD1}}\cdot I_{eQ1} \tag{8}$$

Referring back to FIG. 1, it is now assumed that the resistances of the resistors R1 and R2 are equal to each othr, i.e., R1=R2=R, then the following equations (9) to (11) will be established.

$$I_{eD1}=\tfrac{1}{2}\cdot\frac{e_s}{R1}+\tfrac{1}{2}I_B \tag{9}$$

$$I_{eD2}=\tfrac{1}{2}\cdot I_B-\tfrac{1}{2}\cdot\frac{e_s}{R1} \tag{10}$$

$$I_{eQ1}=I_E-I_{eQ2} \tag{11}$$

By substituting equations (9) to (11) into equation (8), the following equation will be obtained.

$$I_{eQ2}=\frac{\tfrac{1}{2}I_B-\tfrac{1}{2}\cdot\frac{e_s}{R}}{\tfrac{1}{2}\cdot\frac{e_s}{R}+\tfrac{1}{2}I_B}(I_E-I_{eQ2}) \tag{12}$$

$$\therefore\left(\tfrac{1}{2}\cdot\frac{e_s}{R}+\tfrac{1}{2}I_B\right)I_{eQ2}+\left(\tfrac{1}{2}I_B-\tfrac{1}{2}\cdot\frac{e_s}{R1}\right)I_{eQ2}=\left(\tfrac{1}{2}I_B-\tfrac{1}{2}\cdot\frac{e_s}{R}\right)I_E \tag{13}$$

$$\therefore I_{eQ2}=\tfrac{1}{2}I_E-\tfrac{1}{2}\cdot\frac{e_s}{R}\cdot\frac{I_E}{I_B} \tag{15}$$

As apparent from equation (15), the collector current $I_{cQ2}$ of the transistor Q2 (which is equal to $\alpha$ times of the emitter current $I_{eQ2}$ thereof) is proportional to the value of $e_s/I_B$, that is, the signal $e_s$ divided by the sum of the currents flowing in the diodes D1 and D2. It can thus be seen that the division circuit is formed by the provision of the diodes D1 and D2 where the division is effected by the sum of the currents flowing in these diodes with respect to the dividend signal $e_s$.

However, in the case that the division voltage $E_B$ is inadvertently not applied to the division circuit, the divisor current $I_B$ becomes approximately zero, so that the collector current $I_{cQ2}$ flowing into the transistor Q2 becomes infinite as can be understood from equation (15). Thus, it is disadvantageous in the prior art circuit that the gain of the circuit increases abruptly.

SUMMARY OF THE INVENTION

Accordingly, an object of the invention is to provide an improved current-controlled type division circuit eliminating the aforementioned disadvantage.

Briefly, and in accordance with the invention, the above-mentioned object is implemented by the provision of an auxiliary transistor coupled in parallel to a division control transistor which operates to control a divisor current responsive to a division voltage applied to the base thereof. the auxiliary transistor operates so that a predetermined minimum divisor current is flown therethrough when the division voltage applied to the base of the division control transistor falls below a predetermined level.

DETAILED DESCRIPTION OF THE PREFERRED EMBODIMENT

The present invention will now be described with reference to FIGS. 2 and 3.

Figure 1:
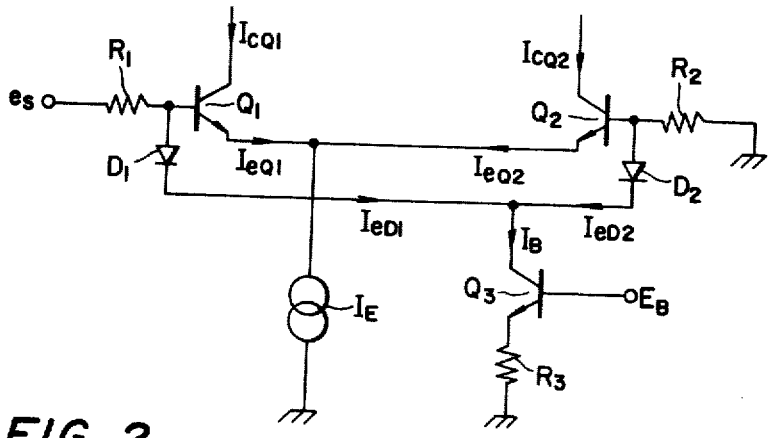
FIG. 1 PRIOR ART
FIG. 1 is a circuit diagram showing an example of a prior art division circuit.
Figure 2:
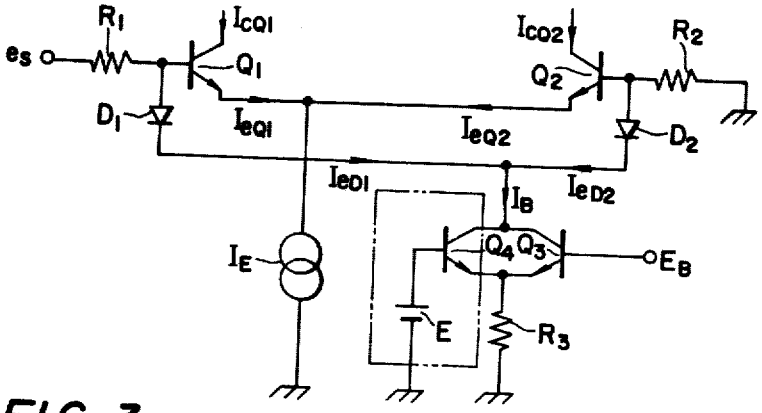
FIG. 2 is a circuit diagram showing one embodiment of the division circuit according to the present invention.

FIG. 2 is a circuit diagram showing one embodiment of the division circuit according to this invention in which same numerals or same characters designate same elements or components as shown in FIG. 1. The circuit arrangement shown in FIG. 2 is similar to that shown in FIG. 1 except the provision of a transistor Q4 and its associated DC voltage supply source E. The transistor Q4 is coupled in parallel to the transistor Q3.

The DC voltage supply source E is connected to the base of the transistor Q4.

Figure 3:
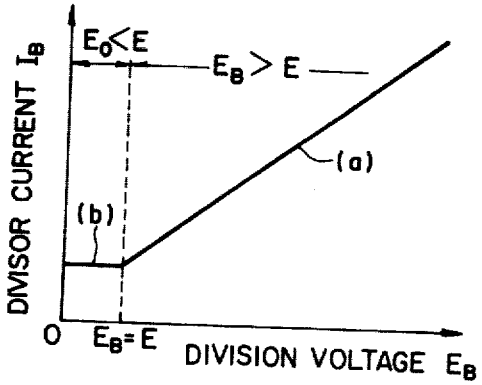
FIG. 3 is a graphical representation showing a relationship of a division voltage $E_B$ and a divisor current $I_B$.

In the division circuit thus arranged, when the division voltage $E_B$ is greater than the voltage E of the source, the divisor current $I_B$ flows into the transistor Q3 and is varied responsive to the division voltage $E_B$ as illustrated in part (a) of FIG. 3, since the transistor Q4 is in OFF state. On the other hand, when the division voltage $E_B$ falls below the DC supply source voltage E, the transistor Q4 is rendered ON whereas the transistor Q3 is rendered OFF, and thus the divisor current $I_B$ flows into the transistor Q4 and the value of the divisor current $I_B$ is maintained constant as defined by $(E-V_{be4})/R3$ and as illustrated in part (b) of FIG. 3. $V_{be4}$ is a base-emitter voltage of the transistor Q4 and is equal to a base-emitter voltage $V_{be3}$ of the transistor Q3, i.e. $V_{be3}=V_{be4}$.

As described, in the division circuit according to the present invention, it is possible to prevent the gain of the circuit from the abrupt and/or extreme increment even when the division voltage $E_B$ is inadvertently not applied, since a minimum divisor current is adapted to be constantly flown into the auxiliary provided transistor Q4 when the division voltage applied to the transistor Q3 falls below a predetermined level.

While the invention has been particularly shown and described with reference to the preferred embodiment thereof, it will be understood by those skilled in the art that various changes may be made therein without departing from the spirit and scope of the invention.

What is claimed is:

1. In a current-controlled type division circuit of the type including a differential circuit having a first and a second transistors, each having an emitter, a base and a collector and wherein the emitters of said first and said second transistors are commonly connected to each other and a dividend signal is applied between the bases thereof, a constant current source being connected to the commonly connected emitters thereof, a first and a second diodes, each having a first and a second terminals and where the first terminals of said first and second diodes are connected to the bases of said first and said second transistors, respectively, and the second terminals thereof are commonly connected to each other, a third transistor having an emitter, a base and a collector, and the collector of said third transistor being connected to the commonly connected second terminals of said first and said second diodes, said third transistor being operable to control a divisor signal flowing in the collector thereof responsive to a division signal applied to the base thereof, the improvement comprising auxiliary means coupled in parallel to said third transistor for flowing the divisor signal when the division signal applied to the base of said third transistor falls below a predetermined minimum.

2. The current-controlled type division circuit as claimed in claim 1 wherein said auxiliary means comprises a fourth transistor having an emitter, a base and a collector and being coupled to said third transistor, and means for applying a predetermined voltage to the base of said fourth transistor.

3. The current-controlled type division circuit as claimed in claim 2 wherein said means for applying the predetermined voltage is a DC voltage supply source.

* * * * *